US010779074B1

(12) United States Patent
VanBlon et al.

(10) Patent No.: US 10,779,074 B1
(45) Date of Patent: Sep. 15, 2020

(54) HEADPHONE WITH MULTIPLE SUPPORT MEMBERS

(71) Applicant: LENOVO (Singapore) PTE. LTD., New Tech Park (SG)

(72) Inventors: Russell Speight VanBlon, Raleigh, NC (US); Robert James Kapinos, Durham, NC (US); Scott Wentao Li, Cary, NC (US); Robert James Norton, Jr., Raleigh, NC (US)

(73) Assignee: Lenovo (Singapore) PTE LTD, New Tech Park (SG)

( * ) Notice: Subject to any disclaimer, the term of this patent is extended or adjusted under 35 U.S.C. 154(b) by 0 days.

(21) Appl. No.: 16/368,773

(22) Filed: Mar. 28, 2019

(51) Int. Cl.
*H04R 1/10* (2006.01)

(52) U.S. Cl.
CPC ..... *H04R 1/1041* (2013.01); *H04R 1/1008* (2013.01)

(58) Field of Classification Search
CPC ..... H04R 5/02; H04R 5/033; H04R 5/0335; H04R 1/1008; H04R 1/105; H04R 1/1058; H04R 1/1066; G06F 3/016; H04M 1/05
USPC ..... 381/374, 379, 370, 371
See application file for complete search history.

(56) References Cited

U.S. PATENT DOCUMENTS 9,756,412 B1 * 9/2017 Bacon ..... H04R 1/1008

OTHER PUBLICATIONS

Dan Seifert, "These Headphones Let You Switch Between Styles in a Snap—The Verge", Smart Home, Jul. 2, 2015, pp. 1-3.

* cited by examiner

*Primary Examiner* — Ahmad F. Matar
*Assistant Examiner* — Sabrina Diaz
(74) *Attorney, Agent, or Firm* — Kunzler Bean & Adamson

(57) ABSTRACT

For earwear with multiple support members supporting multiple configurations, methods, apparatus, and systems are disclosed. One apparatus includes a first support member configured to contact a first portion of a user's head, a second support member configured to contact a second portion of the user's head different than the first, a positioner that moves the first support member and the second support member between a first configuration where the first support member is extended and the second support member is retracted, and a second configuration the first support member is retracted and the second support member is extended.

20 Claims, 9 Drawing Sheets

HEADPHONE WITH MULTIPLE SUPPORT MEMBERS

FIELD

The subject matter disclosed herein relates to headwear and more particularly relates to an earwear with multiple support members supporting multiple configurations.

BACKGROUND

Two very popular headphone form factors are "on the ear" and "over the ear" headphones, but each of these becomes uncomfortable after periods of usage.

BRIEF SUMMARY

Apparatus and systems for earwear with multiple support members supporting multiple configurations are disclosed. In certain embodiments, methods and/or computer program products also perform the functions of the apparatus.

One apparatus includes a pair of earpieces, each earpiece including a first support member configured to contact a user's head at a first location, a second support member configured to contact the user's head at a second location different than the first, a positioner that moves the first support member and the second support member between a first configuration where the first support member is extended and the second support member is retracted, and a second configuration the first support member is retracted and the second support member is extended, and a speaker. The apparatus also includes a headband connecting the pair of earpieces.

In some embodiments of the first apparatus, the first support member contacts a portion of the user's head surrounding an ear when extended, wherein the earpiece covers the ear when the first support member and the second support member are in the first configuration. In some embodiments of the first apparatus, the second support member contacts a portion of the user's ear when extended, wherein the earpiece rests on the ear when the first support member and the second support member are in the second configuration. In some embodiments of the first apparatus, the second support member does not exert pressure on the user's ear the first support member and the second support member are in the first configuration.

In some embodiments of the first apparatus, the positioner includes one of: a lever and a slider. In some embodiments of the first apparatus, the positioner includes a locking mechanism that prevents movement of the first support member with respect to the second support member while the locking mechanism is engaged.

In some embodiments of the first apparatus, the positioner includes a rubber diaphragm having two stable arrangements, wherein the first support member configuration corresponds to a first stable arrangement of the rubber diaphragm and the second support member configuration corresponds to a second stable arrangement of the rubber diaphragm. In some embodiments of the first apparatus, an amount force required to change arrangements of the rubber diaphragm is greater than an amount of force exerted by the headband.

In some embodiments of the first apparatus, the speaker maintains a same distance to the ear between the first support member configuration and the second support member configuration. In certain embodiments, the first apparatus further includes an audio controller that sends signals to the speaker, wherein the audio controller uses a first audio setting in response to the earpiece being in the first configuration and uses a second audio setting in response to the earpiece being in the second configuration.

A second apparatus includes a speaker, a first support member configured to contact a first portion of a user's head, a second support member configured to contact a second portion of the user's head different than the first, and an adjustment member that positions the first support member and the second support member between a first arrangement where the first support member is extended relative to the second support member, and a second arrangement the first support member is retracted relative to the second support member.

In some embodiments of the second apparatus, the earpiece covers the ear when the first support member and the second support member are in the first arrangement, wherein the first support member includes a circum-aural earpad that contacts a portion of the user's head surrounding an ear. In some embodiments of the second apparatus, the earpiece rests on the ear when the first support member and the second support member are in the second arrangement, wherein the second support member includes a supra-aural earpad that contacts a portion of the user's ear.

In some embodiments of the second apparatus, the adjustment member includes one of: a lever and a slider. In some embodiments of the second apparatus, the adjustment member includes a locking mechanism that prevents movement of the first support member with respect to the second support member while the locking mechanism is engaged. In some embodiments of the second apparatus, the adjustment member includes a rubber diaphragm having two stable modes. In such embodiments, the first support member configuration corresponds to a first stable mode of the rubber diaphragm and the second support member configuration corresponds to a second stable mode of the rubber diaphragm.

In certain embodiments of the second apparatus, the speaker maintains a set distance to the ear between the first support member configuration and the second support member configuration. In certain embodiments, the second apparatus further includes an audio controller that sends signals to the speaker, wherein the audio controller adjusts an audio setting in response to the earpiece transitioning from the first arrangement to the second arrangement. In some embodiments of the second apparatus, the audio setting includes at least one of: a volume level, an equalization balance, and noise-cancelling status.

One system includes a pair of earpieces, a headband connecting the pair of earpieces, and an audio controller. Here, each earpiece includes a speaker, an outer earpad configured to contact a user's head at a first location, an inner earpad configured to contact the user's head at a second location different than the first, and an actuator that transitions the outer earpad and the second earpad between a first configuration where the outer earpad is extended relative to the inner earpad, and a second configuration the outer earpad is retracted relative to the inner earpad. Moreover, the audio controller sends signals to each speaker and adjusts an audio setting in response to an earpiece transitioning from the first configuration to the second configuration.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
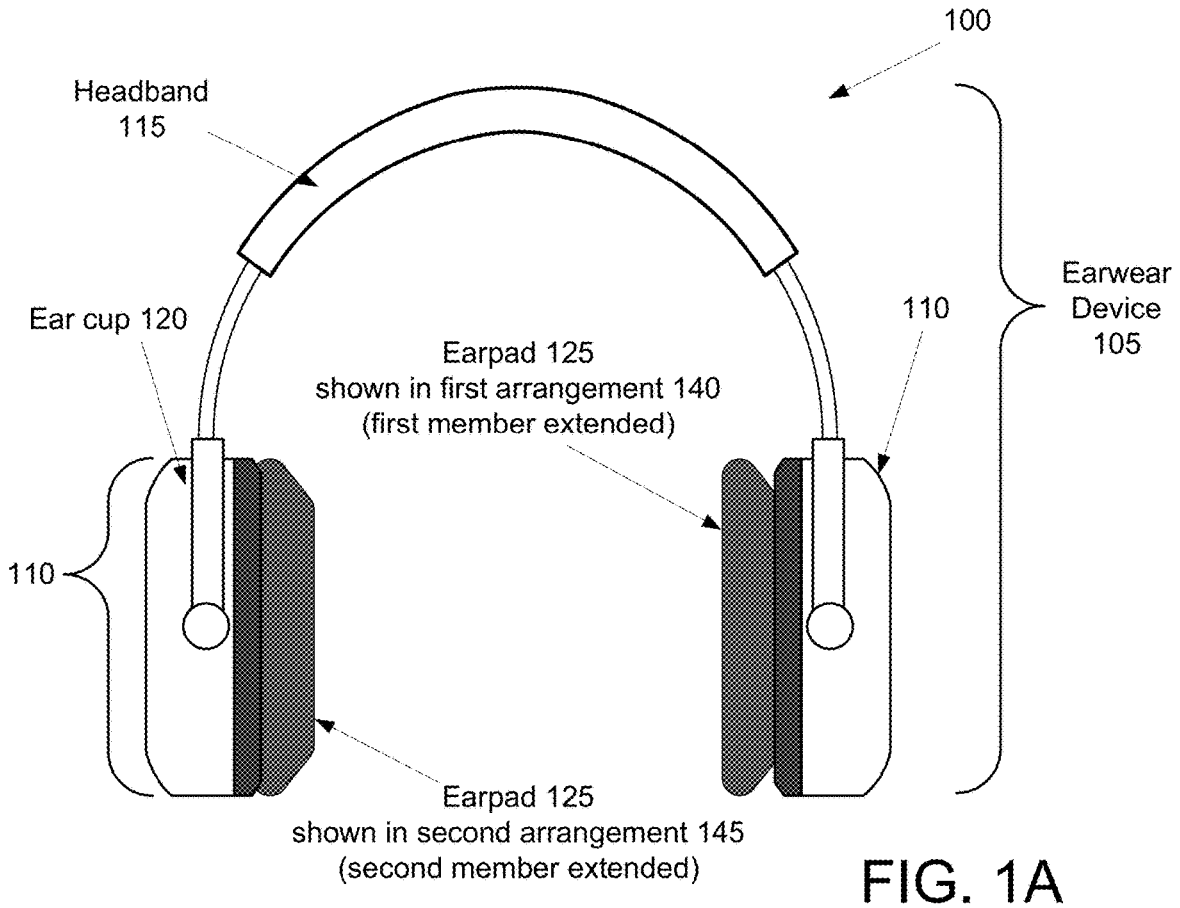
FIG. 1A is a diagram illustrating a front view of earwear with multiple support members supporting multiple configurations.

As will be appreciated by one skilled in the art, aspects of the embodiments may be embodied as a system, apparatus, method, or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, embodiments may take the form of a program product embodied in one or more computer readable storage devices storing machine readable code, computer readable code, and/or program code, referred hereafter as code. The storage devices are tangible, non-transitory, and/or non-transmission. The storage devices do not embody signals. In a certain embodiment, the storage devices may employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object-oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. This code may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods, and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

Two very popular headphone form factors are "on the ear" and "over the ear" headphones, but each of these becomes uncomfortable after periods of usage. To improve comfort when wearing earwear for extended periods of time, a hybrid form factor is disclosed. Here, the earwear may be a headphone that produces an audio signal near the user's ear, an ear muff providing noise isolation or active noise canceling, and the like. Although the user can change out their earwear, it is inconvenient to switch from one set of earwear to another when wearing the current set becomes uncomfortable. Although some earwear may have removable earpieces, it is also inconvenient to switch from one earpiece size to another. The user can remove the earwear temporarily to alleviate discomfort, but this prevents using the earwear, e.g., for listening, noise isolation, and/or noise canceling.

For earwear with multiple support members supporting multiple configurations, methods, systems, and apparatuses are disclosed herein.

The hybrid form factor for earwear includes an earpiece (also referred to as "earcup") that can be adjusted to put pressure on different parts of the user's head. In one example, the hybrid form factor allows switching pressure locations (e.g., the location where the earpiece makes contact with the user's head) between an on-the-ear configuration and an around-the-ear configuration (also referred to as "over-the-ear"), without replacing earpieces or components thereof. The switchable pressure location allows for comfort adjustment while wearing the earwear, thus allowing longer wearing. Note that the hybrid form factor has both configurations installed simultaneously.

In various embodiments, the earwear includes a first support member that touches the user's head at a first location and a second support member that touches the user's head a second location different than the first. Here, the first support member may be an outer support member designed to contact the user's head at a location surrounding the ear, while the second support member may be an inner support member designed to contact the user's ear. Note that both support members of the earpiece are attached to the cylinder (or cup) at the same time, yet allow only one support member to apply pressure to the user's head at a time. Here, the application of pressure to the user's head (e.g., the user's ear or an area surrounding the user's ear) maintains the position of the earwear on the user's head. Accordingly, the earwear may include a headband connected to the earpieces, wherein the headband applies a "clamping" force to secure the earwear to the user's head.

Each earpiece is selectively configurable between at least a first configuration where pressure is applied to the first part of the user's head (e.g., to a region surrounding the ear) and a second configuration where pressure is applied to the second part of the user's head (e.g., to the outer ear). In certain embodiments, the first configuration corresponds to an over-the-ear arrangement of the support members, while the second configuration corresponds to a on the ear arrangement of the support members. When transitioning from the first configuration to the second configuration, the first support member (e.g., outer support member) moves with respect to the second support member (e.g., inner support member), thus changing the location on the user's head where pressure is applied.

In some embodiments, when in the over-the-ear mode, the outer support member touches the user's head and the inner support member is recessed (e.g., retracted) into the earcup (cylinder) relative to the outer support member by an amount sufficient to mitigate pressure on the outer ear (e.g., the auricle or auricula, referring to the fleshy, visible part of the ear that resides outside the head). In various embodiments, the inner support member is recessed relative to the outer support member to a length sufficient that the inner support member does not touch the user's ear. In some embodiments, the inner support member is retracted into the earcup when in the over-the-ear mode. In other embodiments, the inner support member remains stationary relative to the earcup while the outer support member is extended past the inner support member while in the over-the-ear mode.

In certain embodiments, the inner support member is retracted at least 0.5 inches (approximately 1.3 cm) with respect to the outer support member when in the over-the-ear mode. In certain embodiments, the inner support member is retracted up to 1 inch (approximately 2.5 cm) with respect to the outer support member when in the over-the-ear mode. In other embodiments, these distances may vary according to the size of the earwear and/or size of the consumer.

In some embodiments, when in the on-the-ear mode, the inner support member touches the user's head and the outer support member is retracted relative to the inner support member by an amount sufficient to mitigate pressure on the area of the head surrounding the ear. In some embodiments, the outer support member is retracted into the earcup when in the on-the-ear mode. In other embodiments, the outer support member remains stationary relative to the earcup while the inner support member is extended past the outer support member while in the on-the-ear mode.

In certain embodiments, the inner support member protrudes past the outer support member by at least 0.5 inches (approximately 1.3 cm) when in the on-the-ear mode. In certain embodiments, the inner support member protrudes past the outer support member by up to 1 inch (approximately 2.5 cm) with respect to the outer support member when in the over-the-ear mode. In other embodiments, these distances may vary according to the size of the earwear and/or size of the consumer.

In various embodiments, the earwear may include a locking mechanism that prevents the support member configuration from being changed while the locking mechanism is engaged. Here, various locking mechanisms may be implemented, including latches, detents, electric motor resistance, and the like.

When switching from the over-the-ear mode to the on-the-ear mode, the inner and outer support members change arrangement so that the inner support member now touches the user's ear, and pressure is relieved from an area of the user's head surrounding the user's ear. In some embodiments, the on-the-ear mode, leaving an air gap sufficient to allow air flow, for example to improve comfort in case the user sweats after long periods of usage.

In various embodiments, a single speaker unit is present in each earpiece. The speaker units output audible sounds, for example playing music, conversations or providing noise cancellation. As such, the hybrid form factor improves comfort over conventional headphone designs when the user is listening to long periods of music, wearing noise canceling headphones with no audio during a long flight, etc.

Figure 1B:
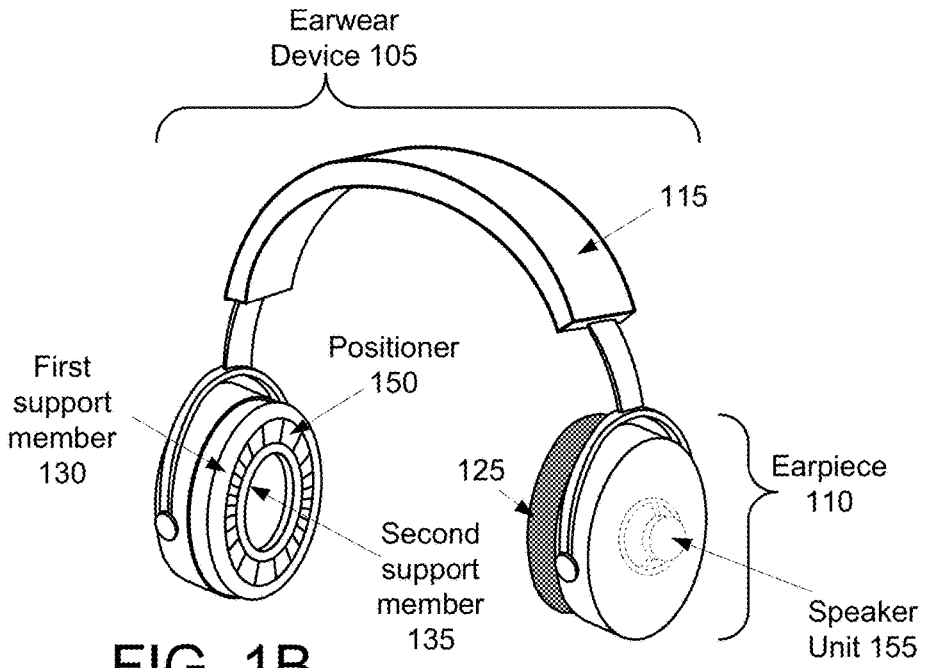
FIG. 1B a perspective view of earwear with multiple support members supporting multiple configurations.

FIG. 1A-1B depicts a system 100 for earwear with multiple support members supporting multiple configurations, according to embodiments of the disclosure. The system 100 includes an earwear device 105. The earwear device 105 includes a pair of earpieces 110 and headband 115. Each earpiece 110 includes an earcup 120 at least one ear pad 125. The earcup 120 and/or ear pad 125 may include sound-deadening material such that the ear where device 105 provides noise isolation to the user. Each earpiece 110 also includes a first support member 130 (also referred to as "outer" support member) and a second support member 135 (also referred to as "inner" support member). The first and second support members are shown in detail in FIG. 1B.

Each earpiece 110 is configurable into a first arrangement 140 where the first support member 130 is extended relative to the second support member 135 and also into a second arrangement 145 where the first support member 130 is retracted relative to the second support member 135. In some embodiments, separate ear pads 125 are attached to the first support member 130 and to the second support member 135. In other embodiments, each earpiece 110 includes a single ear pad 125 with the first and second support members 130-135 located between the ear pad 125 and the earcup 120. Here, the single ear pad 125 may be made of flexible material such that it shape may be distorted according to the arrangement of the first support member 130 and second support member 135.

The first support member 130 and second support member 135 are connected via a positioner 150. The positioner 150 movably couples the first support member 130 to the second support member 135. In certain embodiments, the positioner 150 may be attached to the earcup 120 wherein the first and second support members connect to the earcup via the positioner 150. In one embodiment, the first support member 130 is attached to the earcup 120, while the positioner 150 attaches the second support member 135 to the first support member 130. In another embodiment, the second support member 135 is attached to the earcup 120, while the positioner 150 attaches the first support member 130 to the second support member 135.

Further, the positioner 150 adjusts the relative arrangement of the first support member 130 and the second support member 135. Here, the positioner 150 causes the first and second support members to be positioned in either the first arrangement 140 or the second arrangement 145.

In some embodiments, the positioner 150 comprises a sliding mechanism that moves the first support member 130 relative to the second support member 135. In some embodiments, the positioner 150 comprises a twisting mechanism that moves the first support member 130 relative to the second support member 135. In some embodiments, the positioner 150 comprises a lever that moves the first support member 130 relative to the second support member 135. In some embodiments, the positioner 150 comprises a cam that moves the first support member 130 relative to the second support member 135.

In some embodiments, the positioner 150 comprises a rubber diaphragm with two stable configurations. In one embodiment, applying pressure to the positioner 150 positions the first and second support members in the first arrangement 140. Moreover, applying pressure in a different direction causes the positioner 150 to invert, thus positioning the first and second support members in the second arrangement 145. In some embodiments, the positioner 150 comprises an inflatable bladder. In one embodiment, inflating the bladder (e.g., with air, gas, or liquid) causes the positioner 150 to position the first and second support members into the first arrangement 140. Similarly, deflating the bladder causes the positioner 150 to position the first and second support members into the second arrangement 145. In some embodiments, the positioner 150 comprises an electric motor that was the first support member 130 and second support member 135 between the first arrangement 140 and the second arrangement 145.

As depicted in FIG. 1B the earwear device 105 may include a speaker unit 155 in each earpiece 110, e.g., located inside the earcup 120. However, in some embodiments the earwear device 105 does not include any speakers. Here, each speaker unit 155 may include one or multiple speakers for producing audible sounds. Examples of audible sounds produced by the speaker units 155 include music, voice, white noise, and the like. Note that the ear pad 120 and second support member 135 include apertures such that sound may pass from a speaker unit 155 located within their cup through the apertures to reach the users ear. Thus, the earwear device 105 may be used as headphones, as noise canceling headphones, hearing protection, and like.

As depicted, the earpiece 110 includes a cavity (e.g., provided by the earcup 120). In various embodiments, electronic components (such as the speaker unit 155) and/or sound-deadening material may be placed in the cavity as known in the art of headphones and hearing protection. In certain embodiments, the earwear device 105 may include additional compliments as discussed in greater detail below with reference to FIG. 7.

Figure 2A:
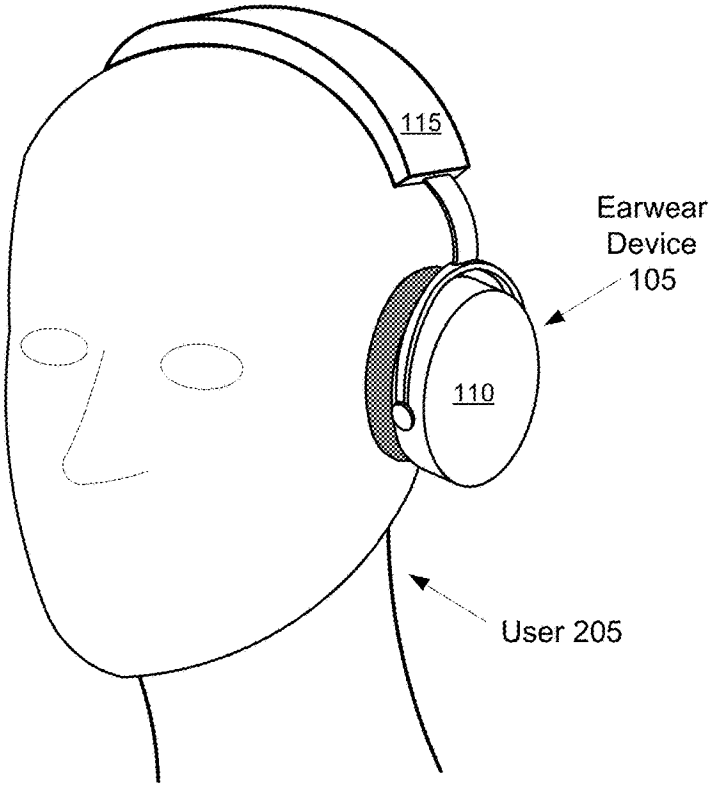
FIG. 2A is a diagram illustrating one embodiment of a user wearing earwear with multiple support members supporting multiple configurations.
Figure 2B:
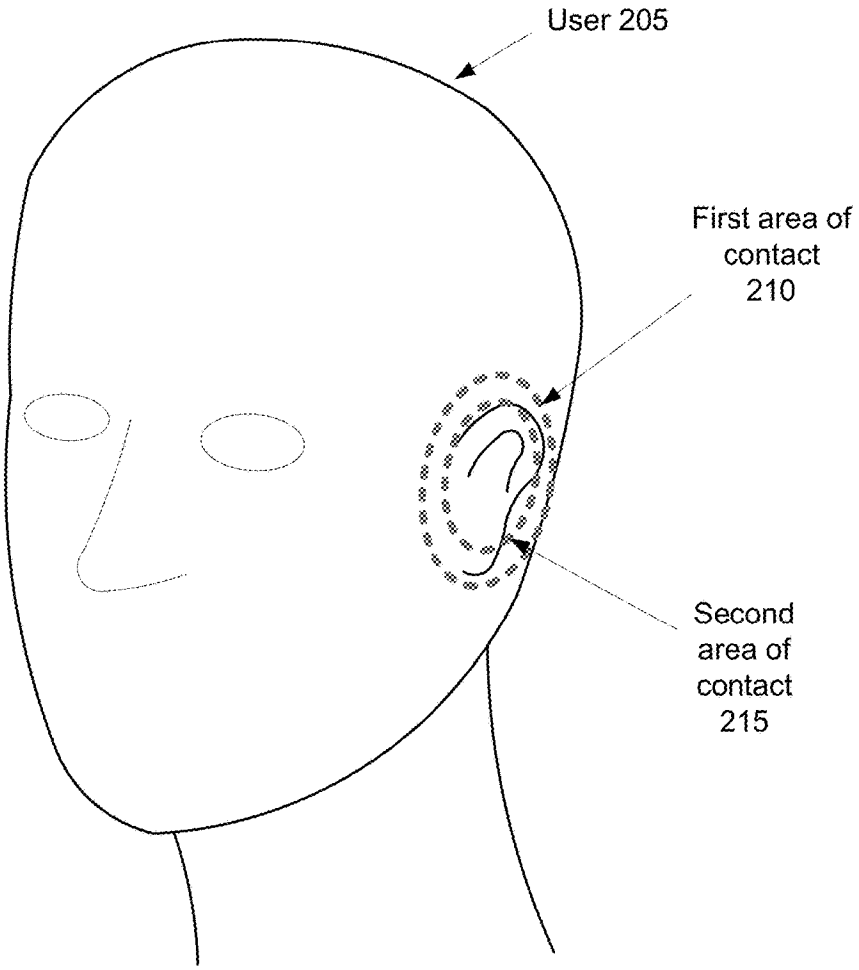
FIG. 2B is a diagram illustrating contact areas of earwear with multiple support members supporting multiple configurations.

FIG. 2A depicts a user 205 wearing the earwear device 105. The earwear device 105 is substantially as described above with reference to FIGS. 1A-1B. FIG. 2B depicts contact areas on the user 205 corresponding to use of the earwear device 105. As depicted, there is a first area of contact 210 and a second area of contact 215 on the user's head. The first area of contact 210 corresponds to a location on the user's head where the first support member 130 makes contact and applies pressure to the user's head. As depicted, the first area of contact 210 includes a region surrounding the user's ear. However, the first year of contact does not include the ear. The second area of contact 215 corresponds to a location on the user's head where the second support member 135 makes contact and applies pressure to the user's head. As depicted, the second area of contact 215 includes the auricle (e.g., fleshy portion of the outer ear).

In the depicted embodiments, when the earwear device 105 is in the first arrangement 140 (e.g., where the first support member 130 is extended relative to the second support member 135) the first support member 130 causes contact at the area 210. Similarly, when the earwear device 105 is in the second arrangement 145 (e.g., where the first support member 130 is retracted relative to the second support member 135) the second support member 135 causes contact at the area 215.

Note that in certain embodiments, when the earwear device 105 is in the first arrangement 140 incidental contact may occur between the second support member 135 and the user's ear; however, because the second support member 135 is retracted relative to the first support member 130 there is minimal pressure applied to the user's ear. Additionally, note that in certain embodiments when the earwear device 105 is in the second arrangement 145 there may be incidental contact in between the first support member 130 and the area 210; however, because the second support member 135 is extended relative to the first support member 130 there is minimal pressure applied to the area 210. While FIG. 2B depicts contact areas on only one side of the head, note that the user 205 may experience pressure at similar locations on the other side of the head (e.g., corresponding to the other earpiece 110 of the earwear device 105).

Figure 3:
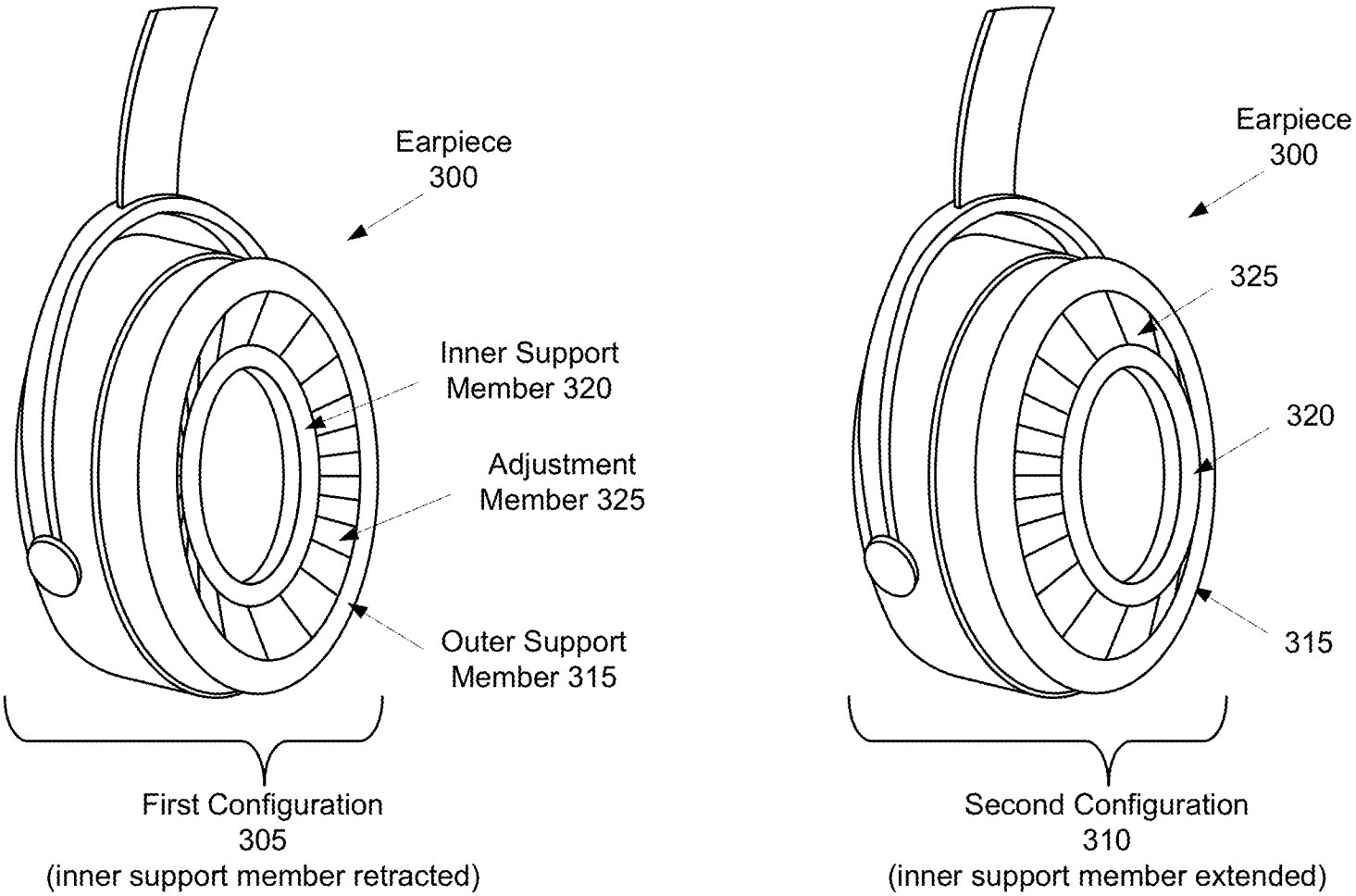
FIG. 3 is a diagram illustrating one embodiment of an earpiece supporting multiple configurations.

FIG. 3 illustrates a detailed view of an earpiece 300 of an earwear device, such as the earwear device 105 described above. The earpiece 300 may be one embodiment of the earpiece 110 described above. FIG. 3 depicts a first configuration 305 and a second configuration 310 of the earpiece 300.

When in the first configuration 305, the inner support member 320 is retracted relative to the outer support member 315. When in the second configuration 310, the inner support member 320 is extended relative to the outer support member 315. Note that the outer support member 315 and inner support member 320 are coupled via an adjustment member 325. The adjustment member 325 may be one embodiment of the positioner 150, described above with reference to FIGS. 1A-1B.

In the depicted example, the outer support member 315 is affixed to an earcup (cylinder) of the earpiece 300 and the inner support member 320 moves in and out of the cavity or depression in the earpiece 300. However, in other embodiments the inner support member 320 may be affixed to the earcup of the earpiece 300 such that the outer support member 315 moves in and out of the cavity or depression in the earpiece 300.

Figure 4A:
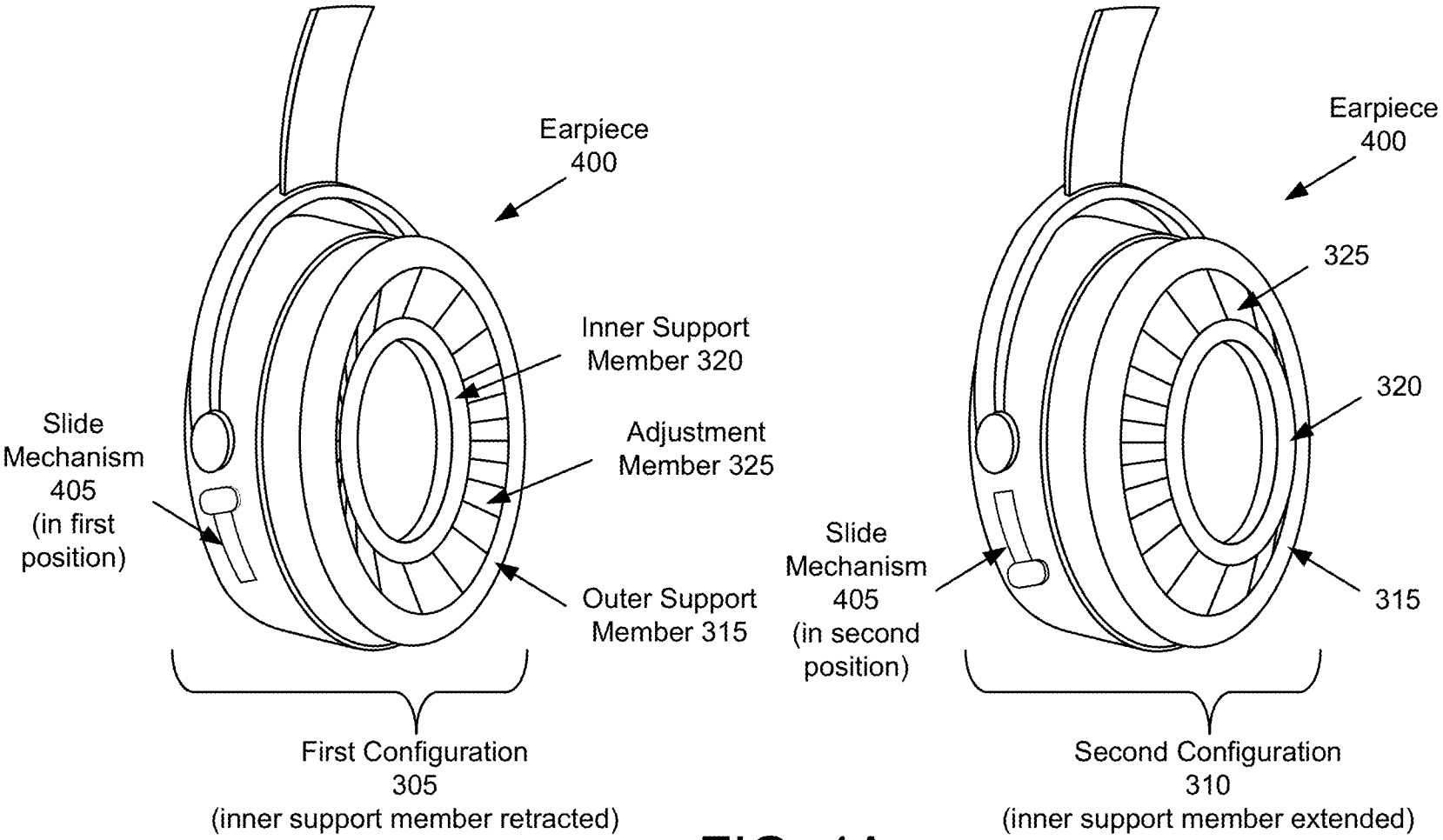
FIG. 4A is a diagram illustrating one embodiment of an earpiece supporting multiple configurations with a slide mechanism.

FIG. 4A illustrates a detailed view of an earpiece 400 of an earwear device, such as the earwear device 105 described above. The earpiece 400 may be one embodiment of the earpiece 110 described above. The earpiece 400 includes an outer support member 315, and inner support member 320, and an adjustment member 325 coupling the outer support member 315 to the inner support member 320. The adjustment member 325 is configured to transition the outer support member 315 and inner support member 320 between the first configuration 305 and the second configuration 310.

Figure 4B:
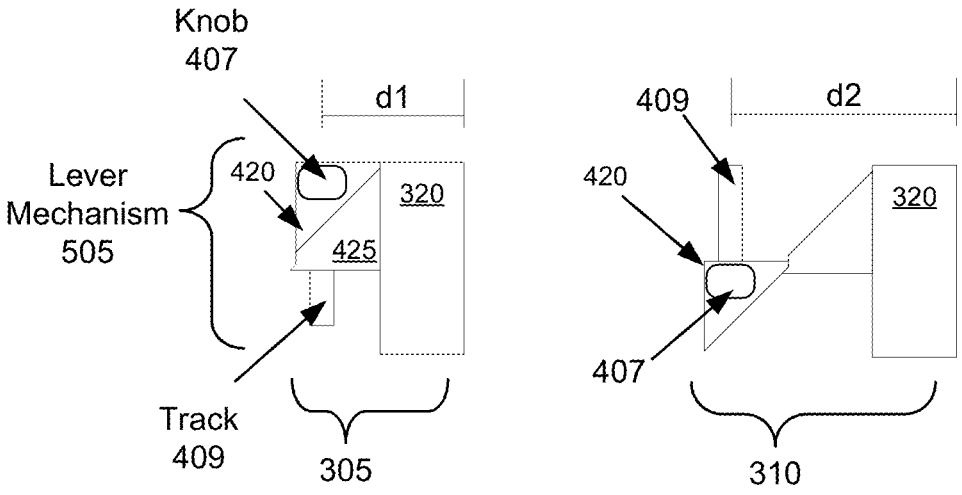
FIG. 4B is a diagram illustrating one embodiment of a slide mechanism supporting multiple configurations of the first and second support members.
Figure 4C:
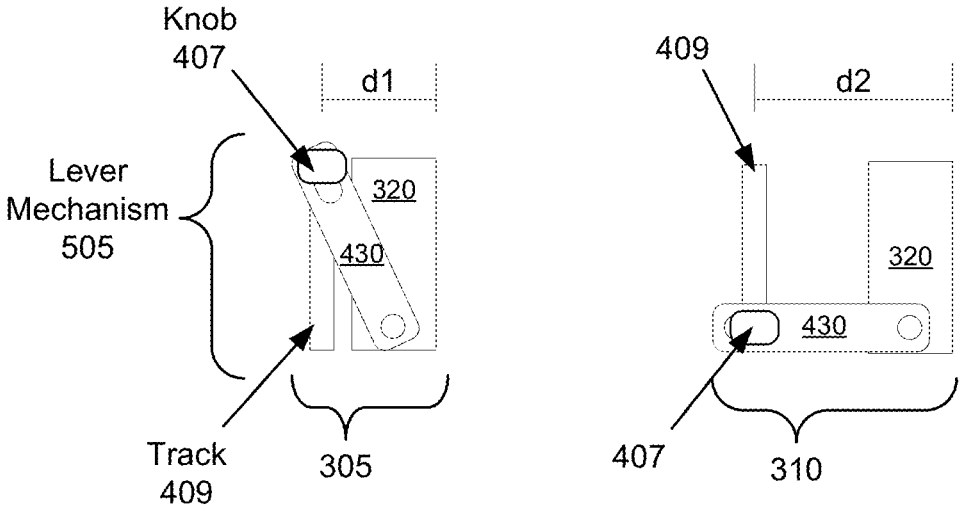
FIG. 4C is a diagram illustrating another embodiment of a slide mechanism supporting multiple configurations of the first and second support members.

In the depicted embodiment, the adjustment member 325 of the earpiece 400 includes a slider mechanism 405. Referring to FIGS. 4B-4C, the slider mechanism 405 includes a knob 407 and a track 409. The knob 407 operates within the track 409. When the slider mechanism 405 is in a first state 410, the earpiece 400 is in the first configuration 305 with the inner support member 320 a first distance ("d1") from the track 409. However, when the slider mechanism 405 is manipulated to a second state 415, the earpiece 400 transitions to the second configuration 310 with the inner support member 320 a second distance ("d2") from the track 409. In various embodiments, the slider mechanism 405 includes a locking mechanism to maintain one or more of the first configuration 305 and second configuration 310. As such, the locking mechanism prevents unintentional transition between the first configuration 305 and second configuration 310.

In the embodiment of FIG. 4B, the slider mechanism 405 includes a first wedge 420 connected to the knob 407. Here, the first wedge 420 acts on the second wedge 425 to move the inner support member 320, causing the transition between the first configuration 305 and the second configuration 310. The adjustment member 325 may include an elastic member, such as spring, rubber diaphragm, etc. biasing the inner support member 320 towards one of the first configuration 305 and the second configuration 310.

In the embodiment of FIG. 4C, the slider mechanism 405 includes an arm 430 coupled to the inner support member 320, where translational movement of the knob 407 on the track 409 is transferred via the arm 430 into translations movement of the inner support member 320 in a direction perpendicular to the motion of the knob 407. In certain embodiments, the translational movement of the knob 407 also causes rotational movement of the inner support member 320.

In other embodiments, the slider mechanism 405 may comprise other methods for moving the inner support member 320 relative to the outer support member 315. For example, the slider mechanism 405 may be control switch signaling an electric motor to move the inner support member 320 relative to the outer support member 315. As another example, the slider mechanism 405 may be coupled to a piston or other suitable device for inflating (or deflating) a bladder, where inflation of the bladder moves the inner support member 320 relative to the outer support member 315. The described examples of the slider mechanism 405 are illustration purposes and not intended to limit the slider mechanism 405 to specific implementations.

Figure 5A:
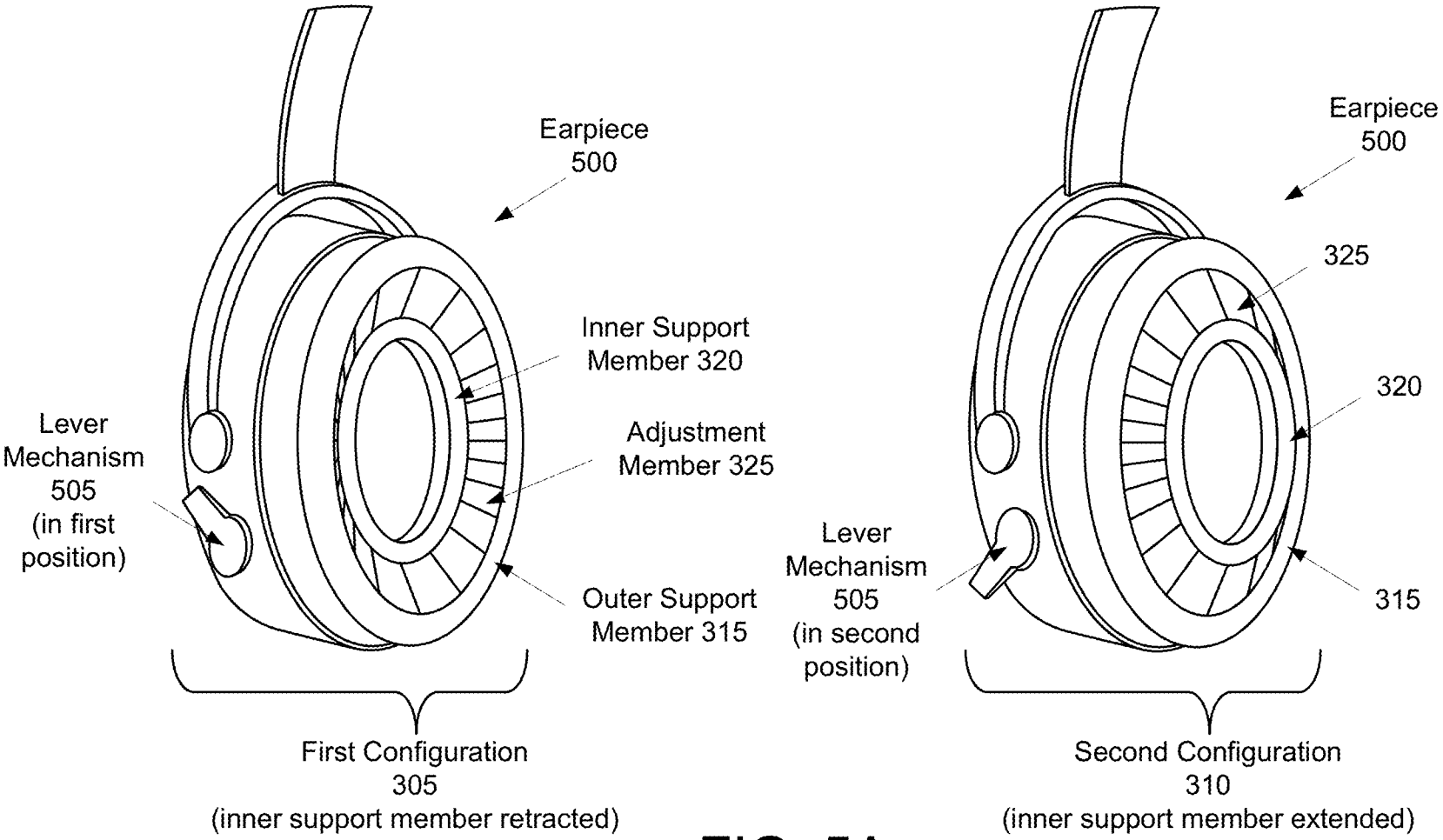
FIG. 5A is a diagram illustrating one embodiment of an earpiece supporting multiple configurations with a lever mechanism.

FIG. 5A illustrates a detailed view of an earpiece 500 of an earwear device, such as the earwear device 105 described above. The earpiece 500 may be one embodiment of the earpiece 110 described above. The earpiece 500 includes an outer support member 315, and inner support member 320, and an adjustment member 325 coupling the outer support member 315 to the inner support member 320. The adjustment member 325 is configured to transition the outer support member 315 and inner support member 320 between the first configuration 305 and the second configuration 310.

Figure 5B:
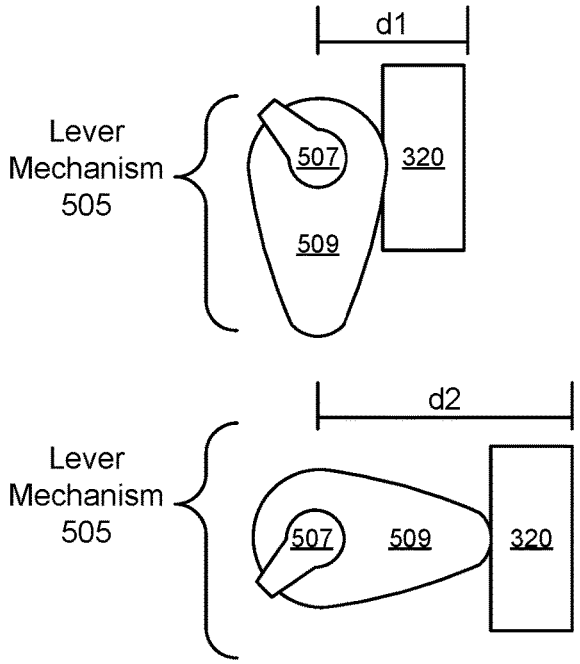
FIG. 5B is a diagram illustrating one embodiment of a lever mechanism supporting multiple configurations of the first and second support members.

In the depicted embodiment, the adjustment member 325 of the earpiece 500 includes a lever mechanism 505. Referring to FIG. 5B, the lever mechanism 505 may include a lever arm 507 and a cam 509. The lever arm 507 rotates the cam 509 which acts upon the inner support member 320. Moreover, the adjustment member 325 may include an elastic member, such as spring, rubber diaphragm, etc. biasing the inner support member 320 towards the first configuration 305. Thus, the cam 509 may act against the elastic force to move the inner support member 320.

When the lever mechanism 505 is in a first state 510, the earpiece 500 is in the first configuration 305 with the inner support member 320 a first distance ("d1") from the lever arm 507. However, when the lever mechanism 505 is manipulated to a second state 515, the earpiece 500 transitions to the second configuration 310 with the inner support member 320 a second distance ("d2") from the lever arm 507. In various embodiments, the lever mechanism 505 includes a locking mechanism to maintain one or more of the first configuration 305 and second configuration 310. As such, the locking mechanism prevents unintentional transition between the first configuration 305 and second configuration 310.

In other embodiments, the lever mechanism 505 may comprise other methods for moving the inner support member 320 relative to the outer support member 315. For example, the lever mechanism 505 may include a second lever arm where rotation of the first lever arm 507 moves the second lever arm, causing translational movement of the inner support member 320. As another example, the lever mechanism 505 may be control switch signaling an electric motor to move the inner support member 320 relative to the outer support member 315. As yet another example, the lever mechanism 505 may be coupled to a piston or other suitable device for inflating (or deflating) a bladder, where inflation of the bladder moves the inner support member 320 relative to the outer support member 315. The described examples of the lever mechanism 505 are illustration purposes and not intended to limit the lever mechanism 505 to specific implementations.

Figure 6:
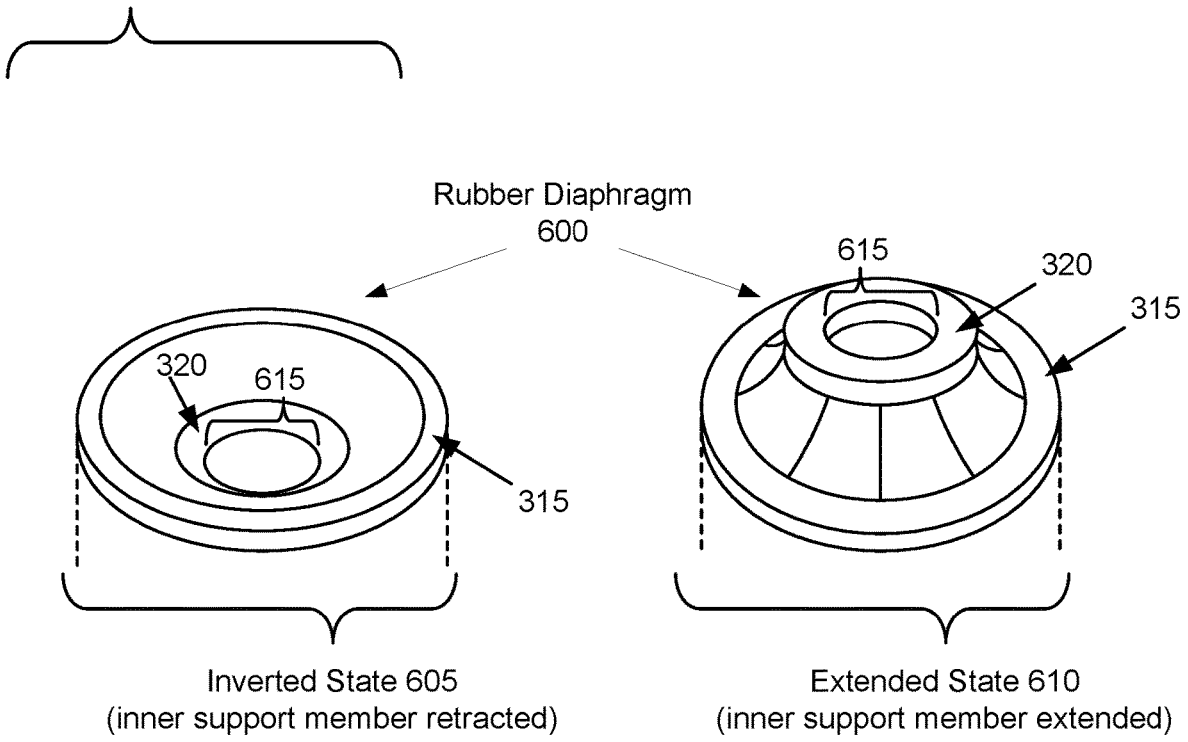
FIG. 6 is a diagram illustrating one embodiment of a rubber diaphragm supporting multiple configurations of the first and second support members.

FIG. 6 depicts one embodiment of a rubber diaphragm 600 used to transition the outer support member 315 with respect to the inner support member 320. The rubber diaphragm 600 is connected to the outer support member 315 and the inner support member 320. The rubber diaphragm 600 as two stable modes, referred to is the inverted state 605 and the extended state 610. When the rubber diaphragm 600 is in the inverted state 605 the outer support member 315 is extended relative to the inner support member 320. However, when the rubber diaphragm 600 is in the extended state 610, the inner support member is extended relative to the outer support member 315.

Note that the rubber diaphragm 600 includes an aperture 615, through which sound may pass. In some embodiments, an inner edge of the rubber diaphragm (e.g., adjacent to the aperture 615) is connected to an earcup, such as the earcup 120. In other embodiments, the outer edge of the rubber diaphragm is connected to the earcup.

Figure 7:
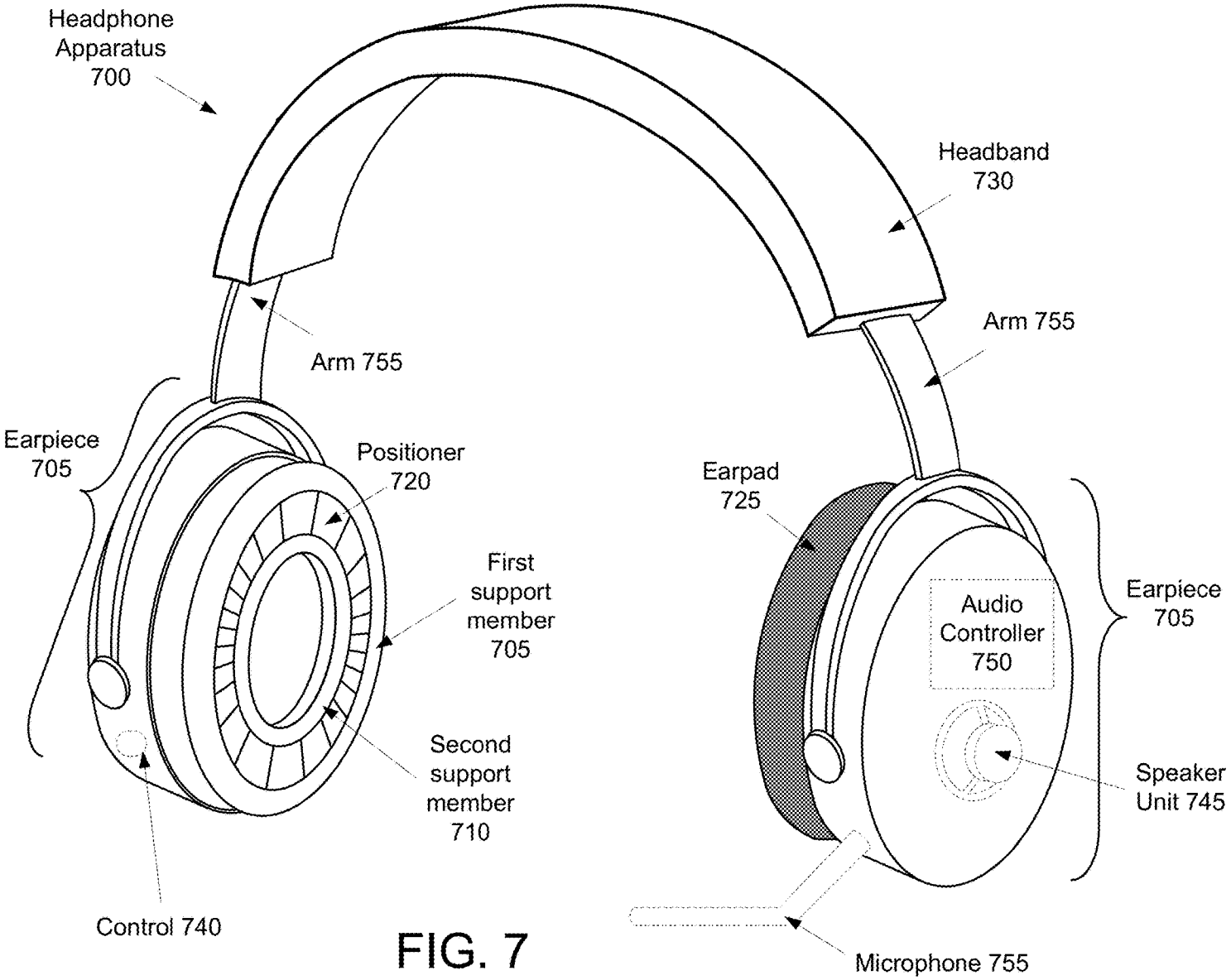
FIG. 7 is a diagram illustrating one embodiment of a headphone apparatus supporting multiple configurations.

FIG. 7 depicts a headphone apparatus 700, which may be one embodiment of the earwear device 105. The headphone apparatus 700 includes a pair of earpieces 705. The earpieces 705 may be substantially similar to the earpieces 110 described above. Moreover, the earpieces 705 may be implemented using any of the earpieces 300, 400, and/or 500 described above.

Each earpiece 705 includes a first support member 710 (e.g., an outer support member) and a second support member 715 (e.g., an inner support member). The first support member 710 and second support member 715 are movably coupled to one another via a positioner 720. In one embodiment, the positioner 720 may be substantially similar to the positioner 150 described above. Moreover, the positioner 720 may be implemented using any of the adjustment members 325 described above. In one embodiment, the positioner 720 is implemented using the rubber diaphragm 600.

The positioner 720 adjusts the relative position of the first support member 710 and the second support member 715. Specifically, the positioner 720 may transition arrangement of the first support member 710 relative to the second support member 715 from a first mode to a second mode. In the first mode, the first support member 710 is extended relative to the second support member 715. In the second mode, the first support member 710 is retracted relative to the second support member 715.

The headphone apparatus 700 includes an ear pad 725. In one embodiment, there is a single ear pad 725 on each earpiece 705, with the ear pad 725 covering the first support member 710 and the second support member 715. The ear pad 725 may be composed of a flexible material so that the shape of the ear pad 725 varies according to the arrangement of the first support member 710 relative to the second support member 715. In another embodiment, there are multiple ear pad 725 on each earpiece 705, for example an outer ear pad covering the first support member 710 and an inner ear pad covering the second support member 715.

The headphone apparatus 700 includes a headband 730. In various embodiments, the headband 730 rests on the top of the user's head. Accordingly, the headband is 730 may include padded material on at least an underside. In various embodiments, the headband 730 is capable of elastic the formation such that the force biasing the headband 730 to its initial shape applies pressure to the user's head via the earpieces 705.

In various embodiments, the headband 730 may include one or more arms 735. In the depicted embodiment, the arms 735 attached to the earpieces 705. In some embodiments, the arms 735 may extend from or retract into the main body of the headband 730 to adjust the size (length) of the headband 730. In some embodiments, the arms 735 act as flats springs, wherein the force biasing the arms 735 to their rest state applies pressure to the user's head via the earpieces 705.

As discussed above, the pressure applied to the user's head when wearing the headphone apparatus 700 can cause discomfort after the headphone apparatus 700 is worn for an extended period of time. To mitigate this discomfort, the headphone apparatus 700 is configured to transition between the first mode in the second mode. When in the first mode, the first support member 710 is extended toward the user's head so that a portion of the ear pad 725 between the first support member 710 is in contact with the user's head and a portion of the ear pad 725 between the second support member 715 and the user does not apply significant pressure to the user's head. Thus, in the first mode the first support member 710 supports the headphone apparatus 700 at a location on the user's head, for example at an area of the head surrounding the ears.

When in the second mode, the second support member 715 is extended toward the user's head so that a portion of the ear pad 725 between the second support member 715 is in contact with the users head and a portion of the ear pad 725 between the first support member 710 and the user does not applies can pressure to the user's head. Thus, in the second mode the second support member 715 supports the headphone apparatus 700 at a second location of the user set, for example on the ears. The user is able to quickly transition between the first mode in the second mode. In various embodiments, the headphone apparatus 700 does not need to be removed from the user's head when transitioning from the first mode to the second mode, or vice versa.

In certain embodiments, the headphone apparatus 700 includes one or more controls 740 for transitioning between the first and second modes. Here, the controls 740 may include one or more buttons, switches, touchpads, or other electronic controls for selecting one of the first mode in the second mode. Upon selection of a mode via the controls 740, the headphone apparatus 700 may switch to the selected mode. In various embodiments, the headphone apparatus 700 may include one or more electric motors, electric pumps, or other electronic controller all devices for moving the first support member 710 relative to the second support member 715.

In certain embodiments, the headphone apparatus 700 includes a speaker unit 745 in each earpiece 705. In some embodiments, the speaker unit 745 remain stationary relative to the earpiece 705 when the headphone apparatus 700 transitions between the first and second modes. Thus, in certain embodiments the relative distance between the user's ear and the speaker unit 745 may change between the first mode and the second mode. In some embodiments, the speaker unit 745 may maintain the same distance relative to the user's ear when the headphone apparatus 700 transitions between the first and second modes. Thus, in certain embodiments, the relative distance between the speaker unit 745 and one or more of the support members 710-715 may change between the first mode in the second mode.

In certain embodiments, the headphone apparatus 700 includes an audio controller 750 a controls audio output at the speaker units 745. The audio controller 750 receives audio input signals and controls the speaker units 745 to output sound corresponding to the input signals. In various embodiments, the audio controller 750 may automatically adjust one or more audio settings when the headphone apparatus 700 transitions between the first and second modes.

The audio controller 750, in various embodiments, may be implemented using an integrated circuit ("IC") chip, a microcontroller, a microprocessor, a central processing unit ("CPU"), a graphics processing unit ("GPU"), a sound card, an auxiliary processing unit, a FPGA, or the like. In certain embodiments, the audio controller 750 is not located within the headphone apparatus 700, but is communicably coupled to the speaker units 745. In certain embodiments, each speaker unit 745 has its own audio controller 750. In other embodiments, the audio controller 750 controls multiple speaker units 745.

In one embodiment, the headphone apparatus 700 (e.g., audio controller 750) adjusts the volume when the headphone apparatus 700 transitions between the first and second modes. For example, the volume level may be adjusted upwards when transitioning from the first mode (e.g., over-the-ear mode) to the second mode (e.g., on-the-ear) to compensate for reduced noise isolation, increased speaker-to-ear distance, or the like.

In one embodiment, the headphone apparatus 700 (e.g., audio controller 750) adjusts an audio equalization when the headphone apparatus 700 transitions between the first and second modes. For example, the audio equalization may be adjusted to change base, mid, and/or treble levels to compensate for different listening environments due to the different modes.

In one embodiment, the headphone apparatus 700 (e.g., audio controller 750) adjusts a noise canceling status when the headphone apparatus 700 transitions between the first and second modes. For example, noise cancellation may be turned off when headphone apparatus 700 is in the first mode (over-the-ear mode) due to the improved noise isolation characteristics of the first mode relative to the second mode. In an alternative example, noise cancellation may be ineffective when the headphone apparatus 700 is in the second mode (on-the-ear mode) and thus the audio controller 750 may turn off noise cancellation when the headphone apparatus 700 is in the second mode.

In certain embodiments, the headphone apparatus 700 includes a microphone 755. Here, the microphone 755 receives audio input, e.g., spoken by the user. Although not shown in FIG. 7, the headphone apparatus 700 may also include an input jack for receiving audio signals (e.g., to be produced by the speaker unit 745). In certain embodiments, the input jack may also be configured to transmit microphone signals. In certain embodiments, the headphone apparatus 700 may include a cord for carrying audio and/or microphone signals.

In various embodiments, the headphone apparatus 700 includes an onboard power supply, such as a rechargeable battery. In some embodiments, the headphone apparatus 700 includes a wireless transceiver. Here, the wireless transceiver uses wireless network connections to receive audio signals to be produced by the speaker unit 745 and/or transmit microphone signals received at the microphone 755. Moreover, status information of the headphone apparatus 700 may be communicated using the wireless transceiver. For example, battery status information may be sent to a connected device.

The wireless transceiver may include hardware circuits and/or software (e.g., drivers, modem, protocol/network stacks) to support wired or wireless communication between the headphone apparatus 700 and another device or network, such as the media player, telephone, smart phone, tablet computer, laptop computer, desktop computer, or other suitable device. The wireless connection may include a mobile telephone network. The wireless connection may also employ a Wi-Fi network based on any one of the Institute of Electrical and Electronics Engineers (IEEE) 802.11 standards. Alternatively, the wireless connection may be a BLUETOOTH® connection. In addition, the wireless connection may employ a Radio Frequency Identification (RFID) communication including RFID standards established by the International Organization for Standardization (ISO), the International Electrotechnical Commission (IEC), the American Society for Testing and Materials® (ASTM®), the DASH7™ Alliance, and EPCGlobal™.

Alternatively, the wireless connection may employ a ZigBee® connection based on the IEEE 802 standard. In one embodiment, the wireless connection employs a Z-Wave® connection as designed by Sigma Designs®. Alternatively, the wireless connection may employ an ANT® and/or ANT+® connection as defined by Dynastream® Innovations Inc. of Cochrane, Canada.

The wireless connection may be an infrared connection including connections conforming at least to the Infrared Physical Layer Specification (IrPHY) as defined by the Infrared Data Association® (IrDA®). Alternatively, the wireless connection may be a cellular telephone network communication. All standards and/or connection types include the latest version and revision of the standard and/or connection type as of the filing date of this application.

Figure 8:
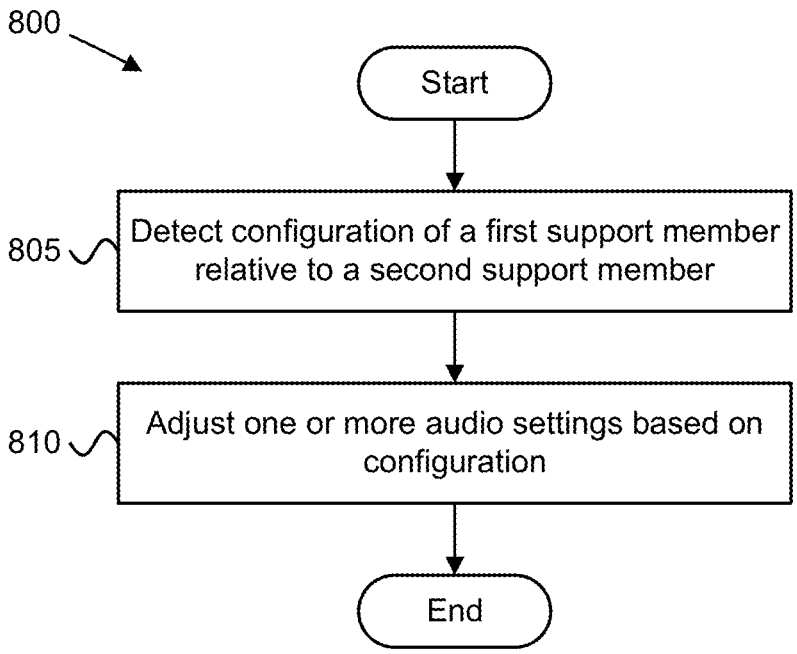
FIG. 8 is a flowchart diagram illustrating one embodiment of a method of an audio controller supporting multiple configurations.

FIG. 8 depicts a method 800 of an audio controller, according to embodiments of the disclosure. In some embodiments, the method 800 is performed by the earwear device 105, the headphone apparatus 700, and/or the audio controller 750, described above. In some embodiments, the method 800 is performed by a processor, such as a microcontroller, a microprocessor, a central processing unit (CPU), a graphics processing unit (GPU), an auxiliary processing unit, a FPGA, or the like.

The method 800 begins and determines 805 a configuration of a first support member relative to a second support member. In various embodiments, the detected configuration is a first arrangement corresponding to an over-the-ear configuration of the first and second support members. In other embodiments, the detected configuration is a second arrangement corresponding to an on-the-year configuration of the first and second support members. The method 800 includes adjusting 810 one or more audio settings based on the configuration. The audio setting may include a volume level, an audio equalization, and/or a noise canceling status. The method 800 ends.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A headphone apparatus comprising:

a pair of earpieces, each earpiece comprising;

a speaker;

a first support member configured to contact a user's head at a first location;

a second support member configured to contact the user's head at a second location different than the first; and a positioner that moves the first support member and the second support member between a first configuration where the first support member is extended with respect to the second support member, and a second configuration the first support member is retracted with respect to the second support member, wherein the positioner comprises a rubber diaphragm having two stable arrangements, wherein the first configuration corresponds to a first stable arrangement of the rubber diaphragm and the second configuration corresponds to a second stable arrangement of the rubber diaphragm; and a headband connecting the pair of earpieces.

2. The apparatus of claim 1, wherein the first support member contacts a portion of the user's head surrounding the user's ear when extended, wherein the earpiece covers the user's ear when the first support member and the second support member are in the first configuration.

3. The apparatus of claim 1, wherein the second support member contacts a portion of the user's ear when extended, wherein the earpiece rests on the user's ear when the first support member and the second support member are in the second configuration.

4. The apparatus of claim 3, wherein the second support member does not exert pressure on the user's ear when the first support member and the second support member are in the first configuration.

5. The apparatus of claim 1, wherein the positioner comprises one of a lever and a slider.

6. The apparatus of claim 1, wherein the positioner comprises a locking mechanism that prevents movement of the first support member with respect to the second support member while the locking mechanism is engaged.

7. The apparatus of claim 1, wherein an amount force required to change arrangements of the rubber diaphragm is greater than an amount of force exerted by the headband.

8. The apparatus of claim 1, wherein the speaker maintains a same distance to the user's ear between the first configuration and the second configuration.

9. The apparatus of claim 1, further comprising an audio controller that sends signals to the speaker, wherein the audio controller uses a first audio setting in response to the earpiece being in the first configuration and uses a second audio setting in response to the earpiece being in the second configuration.

10. An earpiece apparatus comprising;

a first support member configured to contact a first portion of a user's head;

a second support member configured to contact a second portion of the user's head different than the first;

an adjustment member that positions the first support member and the second support member in one of: a first arrangement where the first support member is extended relative to the second support member and a second arrangement where the first support member is retracted relative to the second support member, wherein the adjustment member comprises a rubber diaphragm having two stable modes, wherein the first arrangement corresponds to a first stable mode of the adjustment member and the second arrangement corresponds to a second stable mode of the adjustment member; and a speaker.

11. The apparatus of claim 10, wherein the earpiece covers the user's ear when the first support member and the second support member are in the first arrangement, wherein the first support member comprises a circum-aural earpad that contacts a portion of the user's head surrounding the user's ear.

12. The apparatus of claim 10, wherein the earpiece rests on the user's ear when the first support member and the second support member are in the second arrangement, wherein the second support member comprises a supra-aural earpad that contacts a portion of the user's ear.

13. The apparatus of claim 10, wherein the adjustment member comprises one of a lever and a slider.

14. The apparatus of claim 10, wherein the adjustment member comprises a locking mechanism that prevents movement of the first support member relative to the second support member while the locking mechanism is engaged.

15. The apparatus of claim 10, wherein the speaker maintains a set distance to the user's ear between the first arrangement and the second arrangement.

16. The apparatus of claim 10, further comprising an audio controller that sends signals to the speaker, wherein the audio controller adjusts an audio setting in response to the earpiece transitioning from the first arrangement to the second arrangement.

17. The apparatus of claim 16, wherein the audio setting comprises at least one of:

a volume level, an equalization balance, and noise-cancelling status.

18. A system comprising:

a pair of earcups, each earcup comprising;

a speaker;

an outer earpad configured to contact a user's head at a first location;

an inner earpad configured to contact the user's head at a second location different than the first; and an actuator that transitions the outer earpad and the inner earpad between a first mode where the outer earpad is extended relative to the inner earpad, and a second mode the outer earpad is retracted relative to the inner earpad;

a headband connecting the pair of earcups; and an audio controller that sends signals to each speaker, wherein the audio controller adjusts an audio setting in response to an earcup transitioning from the first mode to the second mode.

19. The system of claim 18, wherein the audio setting comprises at least one of: a volume level, an equalization balance, and noise-cancelling status.

20. The system of claim 18, wherein the speaker maintains a set distance to the user's head between the first mode and the second mode.

* * * * *